US010808393B2

(12) United States Patent
Yin et al.

(10) Patent No.: US 10,808,393 B2
(45) Date of Patent: Oct. 20, 2020

(54) METHOD FOR FORMING A PLURALITY OF BEAMS CONNECTED IN SERIES

(71) Applicant: RUENTEX ENGINEERING & CONSTRUCTION CO., LTD., Taipei (TW)

(72) Inventors: Samuel Yin, Taipei (TW); Jui-Chen Wang, Taipei (TW); Kun-Jung Shu, Taipei (TW)

(73) Assignee: RUENTEX CONSTRUCTION & ENGINEERING CO., LTD., Taipei (TW)

( * ) Notice: Subject to any disclaimer, the term of this patent is extended or adjusted under 35 U.S.C. 154(b) by 29 days.

(21) Appl. No.: 15/823,959

(22) Filed: Nov. 28, 2017

(65) Prior Publication Data

US 2019/0078314 A1 Mar. 14, 2019

(30) Foreign Application Priority Data

Sep. 11, 2017 (TW) ..... 106130912 A

(51) Int. Cl.
*E04B 1/20* (2006.01)
*E04G 17/16* (2006.01)
(Continued)

(52) U.S. Cl.
CPC ..... *E04B 1/20* (2013.01); *E04B 1/164* (2013.01); *E04B 5/17* (2013.01); *E04B 5/265* (2013.01);
(Continued)

(58) Field of Classification Search
CPC ... E04B 1/20; E04B 5/17; E04B 5/265; E04B 5/28; E04B 1/164; E04B 5/29;
(Continued)

(56) References Cited

U.S. PATENT DOCUMENTS 914,861 A * 3/1909 Muldoon ..... E04C 5/02 52/649.1
992,733 A * 5/1911 Conzelman ..... E04B 5/43 52/646
(Continued)

FOREIGN PATENT DOCUMENTS

CN 2683763 Y 3/2005
CN 2687227 Y 3/2005
(Continued)

*Primary Examiner* — Phi D A
(74) *Attorney, Agent, or Firm* — Juan Carlos A. Marquez; Marquez IP Law Office, PLLC

(57) ABSTRACT

A method for forming a plurality of beams connected in series is provided. The method comprises the following steps: providing a plurality of columns; providing a plurality of pre-assembled bar combinations, wherein each of the plurality of pre-assembled bar combinations comprises a plurality of lower main bars and a plurality of lower stirrups, and at least one end of the plurality of the lower main bars has connection sections extending beyond the plurality of lower stirrups; hoisting each of the bar combinations so that the two ends thereof are placed on top of two adjacent columns of the plurality of columns and the connection sections of the plurality of lower main bars of adjacent plurality of bar combinations overlap; and connecting the plurality of connection sections of the plurality of lower main bars of the adjacent plurality of bar combinations.

8 Claims, 14 Drawing Sheets

(51) Int. Cl.

| | |
|---|---|
| ***E04C 3/20*** | (2006.01) |
| ***E04B 5/29*** | (2006.01) |
| ***E04B 5/17*** | (2006.01) |
| ***E04B 5/26*** | (2006.01) |
| ***E04B 5/28*** | (2006.01) |
| ***E04B 1/16*** | (2006.01) |
| ***E04B 5/48*** | (2006.01) |
| ***E04C 5/06*** | (2006.01) |

(52) U.S. Cl.
CPC ..... *E04B 5/28* (2013.01); *E04B 5/29* (2013.01); *E04B 5/48* (2013.01); *E04C 3/20* (2013.01); *E04C 5/0609* (2013.01); *E04G 17/16* (2013.01); *E04B 2005/176* (2013.01)

(58) Field of Classification Search
CPC . E04B 5/0609; E04B 2005/176; E04G 17/16; E04C 3/20; E04C 5/48
See application file for complete search history.

(56) References Cited

U.S. PATENT DOCUMENTS 1,142,805 A * 6/1915 Ellinger ..... E04G 1/14 52/637
1,659,035 A * 2/1928 Lovell ..... E04C 5/065 52/646
1,693,941 A * 12/1928 Schuster ..... E04B 5/43 52/261
1,926,182 A * 9/1933 Sereff ..... E04B 5/29 52/326
2,587,724 A * 3/1952 Henderson ..... E04B 1/21 52/649.2
3,283,458 A * 11/1966 Gersovitz ..... E04C 5/0645 52/260
3,302,360 A * 2/1967 Bjerking ..... E04C 5/0645 52/600
3,778,951 A * 12/1973 Oroschakoff ..... E04C 5/167 52/646
4,333,285 A * 6/1982 Koizumi ..... E04B 1/21 52/236.3
5,248,122 A * 9/1993 Graham ..... E04C 2/044 249/91
5,317,847 A * 6/1994 Scairono ..... E04C 3/02 52/204.1
5,392,580 A * 2/1995 Baumann ..... B21F 27/125 52/646
6,263,629 B1 * 7/2001 Brown, Jr. ..... E04C 2/044 442/179
6,293,063 B2 * 9/2001 Van Doren ..... E04B 1/165 52/250
6,385,930 B1 * 5/2002 Broms ..... E04B 5/43 52/223.6
7,143,554 B2 * 12/2006 Sachs ..... E04C 3/20 52/251
7,784,235 B2 * 8/2010 Cretti ..... E04C 5/065 52/332
2006/0059804 A1 * 3/2006 Brown ..... E04C 5/0604 52/223.13
2012/0090262 A1 * 4/2012 Scola ..... E04C 5/064 52/676
2012/0137619 A1 * 6/2012 Martter ..... E04C 5/0645 52/649.1
2012/0177873 A1 * 7/2012 Gunther ..... E04C 5/166 428/114
2013/0014454 A1 * 1/2013 Caboni ..... E04B 5/19 52/173.1
2018/0002925 A1 * 1/2018 Kwon ..... E04C 3/205

FOREIGN PATENT DOCUMENTS

| | | |
|---|---|---|
| CN | 205530682 U | 8/2016 |
| CN | 106812244 A | 6/2017 |
| TW | M288896 | 3/2006 |
| TW | 200930868 | 7/2009 |

* cited by examiner

METHOD FOR FORMING A PLURALITY OF BEAMS CONNECTED IN SERIES

FIELD OF THE INVENTION

This disclosure relates to a construction method, in particular a construction method for forming beams connected in series.

BACKGROUND OF THE INVENTION

A conventional method for forming a beam within a working area is shown in FIGS. 1A and 1B. Moldboards 7 are disposed between two adjacent columns of a plurality of columns (not shown) with two ends thereof, and then bars such as lower main bars 111 and lower stirrups 112 are disposed within the space formed by the moldboards 7. After the lower main bars 111 and the lower stirrups 112 are disposed therein, upper main bars 113 and upper stirrups 114 are provided and fastened to the lower main bars 111 and the lower stirrups 112 to form reinforcement cages 11 as shown in FIG. 1B. Thereafter, concrete is poured into the space formed by the moldboards 7. As the conventional method above is performed at a level of the tops of the columns where limited spaces are provided, it is inconvenient for the workers to fasten stirrups within the limited working area, and safety issues are a concern when the workers work at such high level.

SUMMARY OF THE INVENTION

To solve the issues of the conventional method, one embodiment of this disclosure provides a method for forming a plurality of beams connected in series. The method comprises the following steps: providing a plurality of columns; providing a plurality of pre-assembled bar combinations, wherein each of the plurality of bar combinations comprises a plurality of lower main bars and a plurality of lower stirrups, and at least one end of the plurality of the lower main bars has connection sections extending beyond the plurality of lower stirrups; hoisting each of the plurality of bar combinations to dispose each of the plurality of bar combinations between two adjacent columns, wherein the two ends of each of the plurality of bar combinations are respectively disposed on top of the two adjacent columns of the plurality of columns, and the connection sections of the plurality of lower main bars of adjacent plurality of bar combinations overlap; and connecting the plurality of connection sections of the plurality of lower main bars of the adjacent plurality of bar combinations.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein:

FIG. 1 B is another schematic view showing the conventional method for forming the beam.

DETAILED DESCRIPTION OF THE INVENTION

The following is the detailed description for the embodiments of this disclosure in reference to the drawings. The detailed description for the embodiments is for illustration of the specific examples of this disclosure and is not to limit the scope of the application.

Figure 1A:
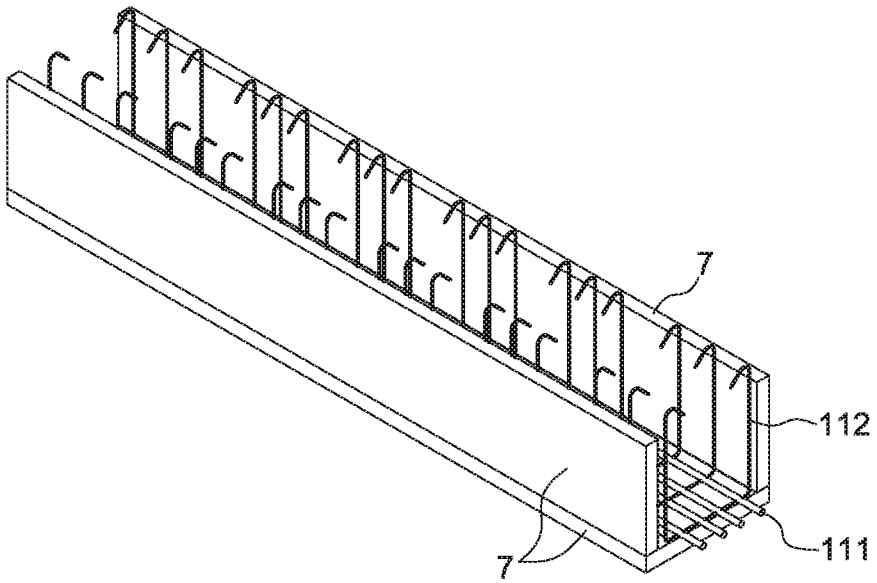
FIG. 1 A is a schematic view showing a conventional method for forming a beam.
Figure 1B:
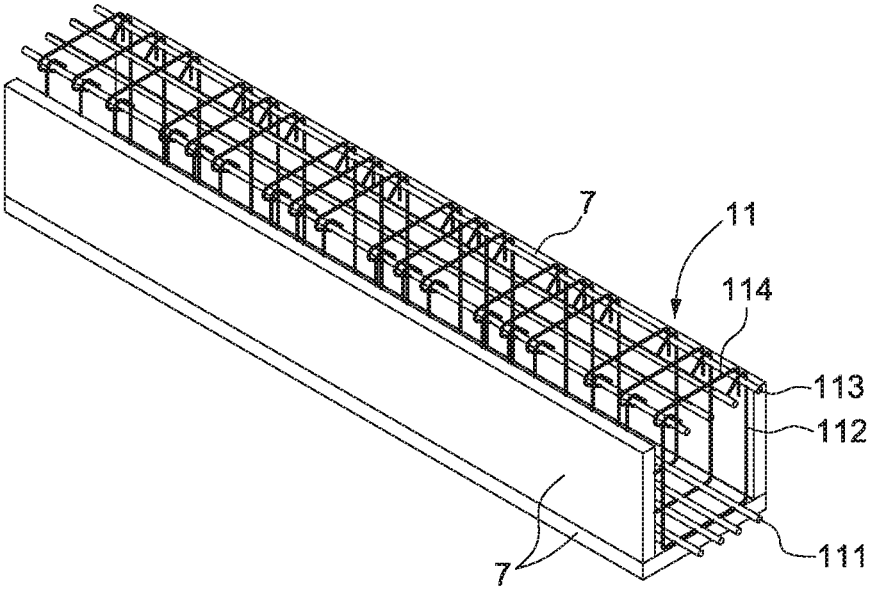
Figure 2A:
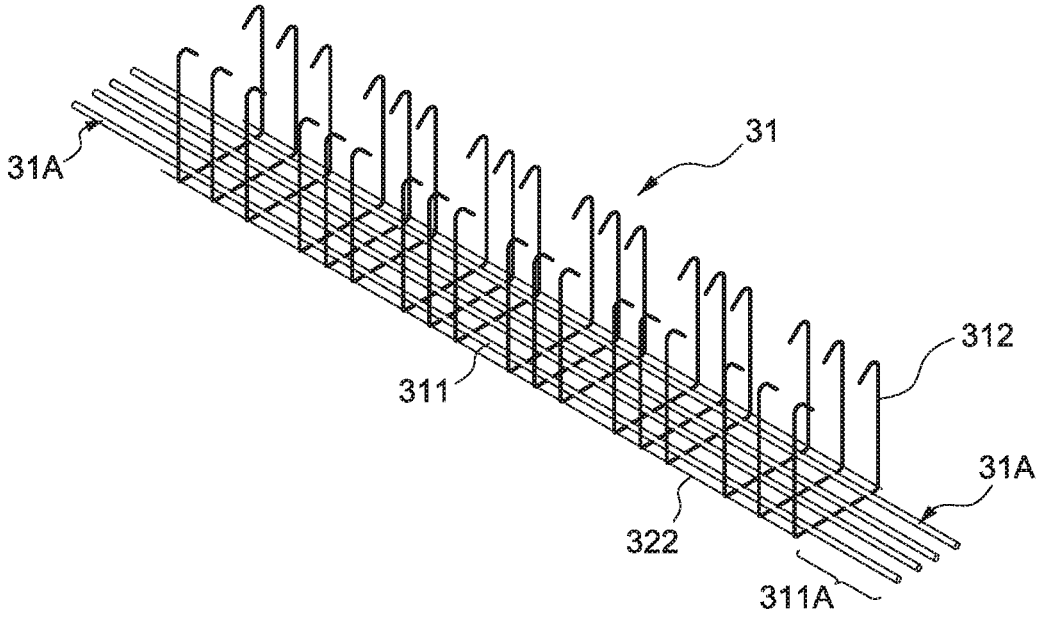
FIG. 2 A is a schematic view of a pre-assembled bar combination according to one embodiment of this disclosure.
FIGS. 2B-2D are schematic views showing pre-assembled bar combinations hoisted onto adjacent columns.
Figure 2B:
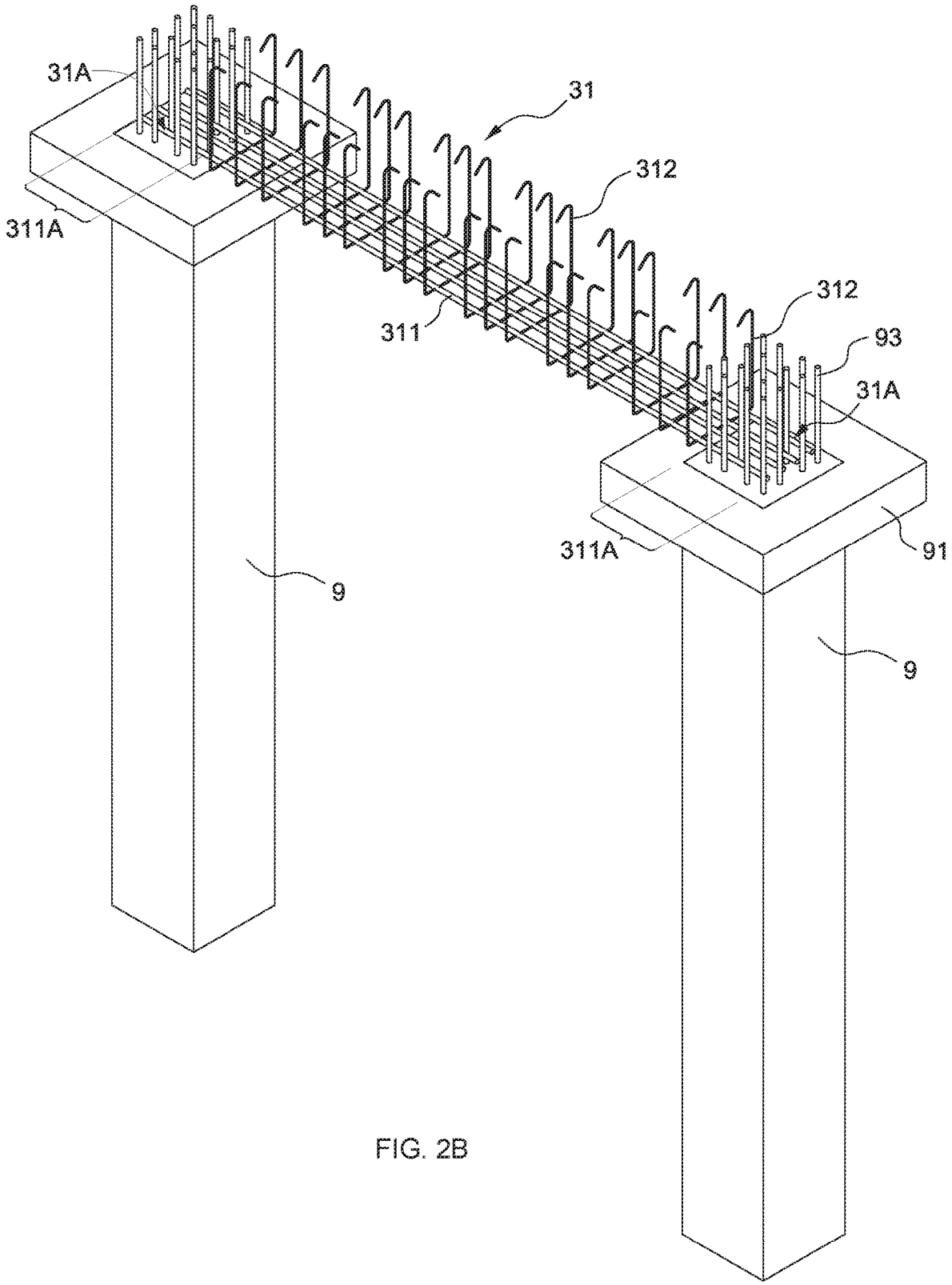
Figure 2C:
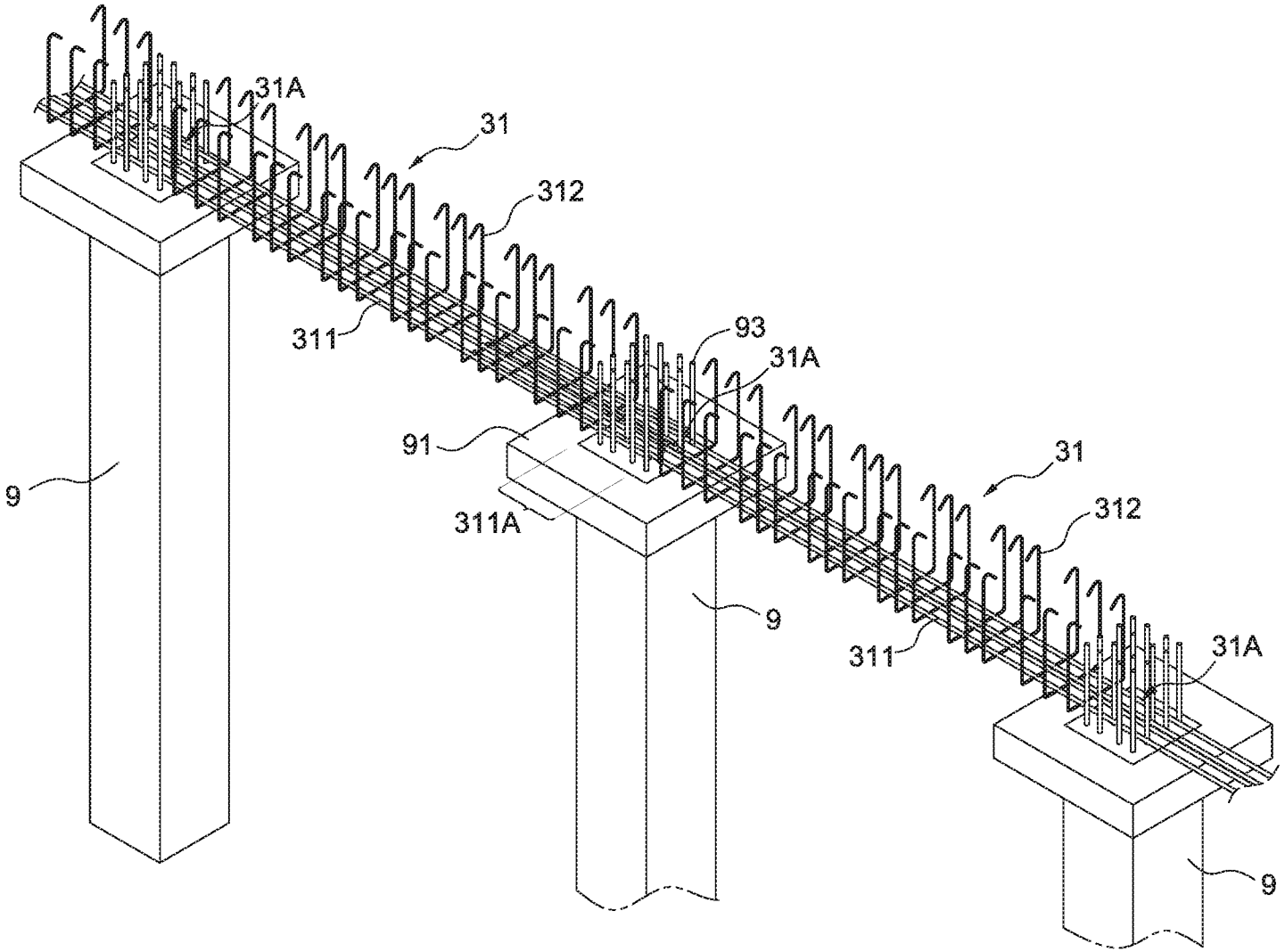
Figure 2D:
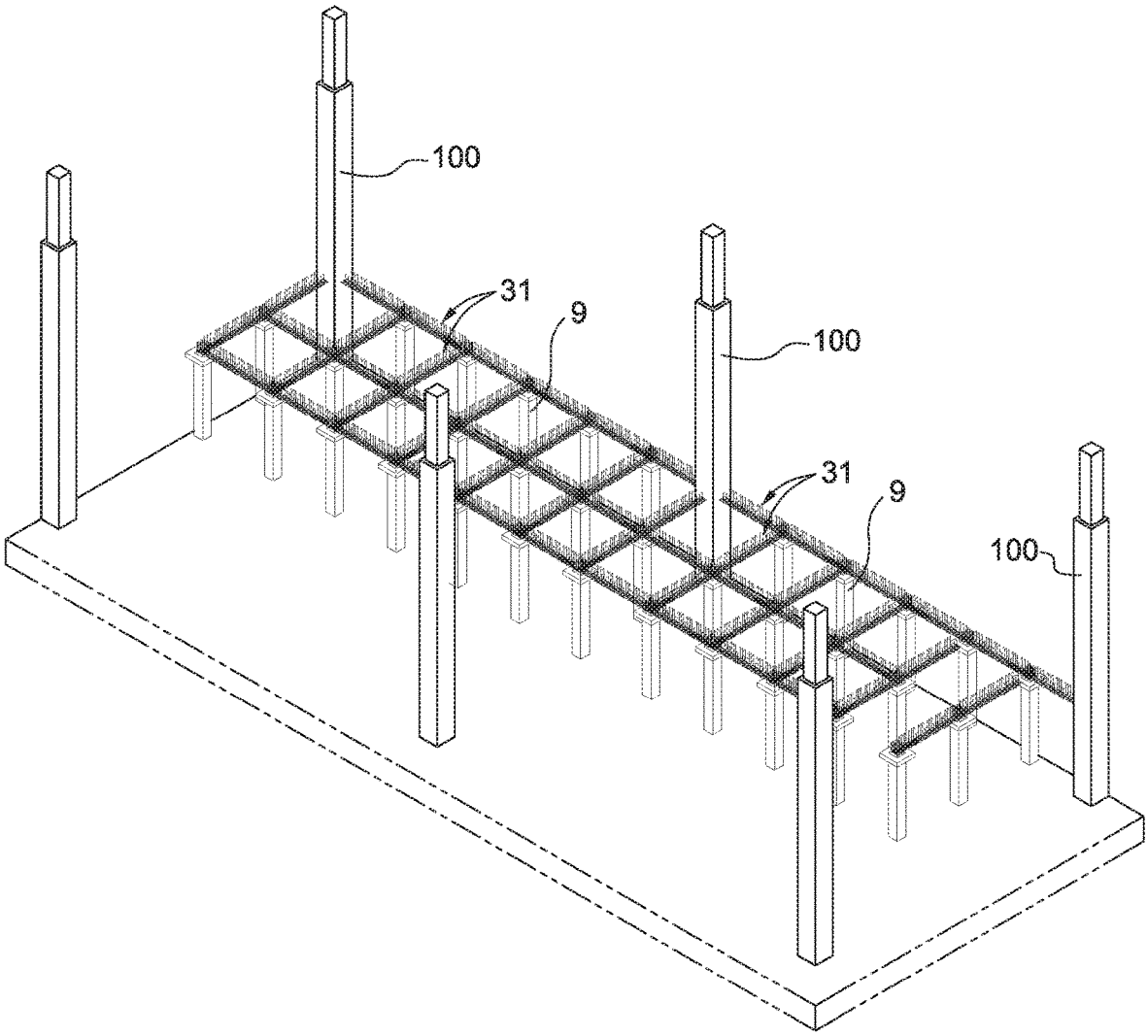

First, please refer to FIGS. 2A-2D. According to one embodiment of this disclosure, the method for forming a plurality of beams connected in series comprises the following steps: providing a plurality of columns 9 (FIGS. 2B and 2C); providing a plurality of pre-assembled bar combinations 31, wherein each of the plurality of bar combinations 31 (see FIG. 2A) comprises a plurality of lower main bars 311 and a plurality of lower stirrups 312, and at least one end of the plurality of the lower main bars 311 has connection sections 311A substantively extending beyond the plurality of lower stirrups 312; hoisting each of the plurality of bar combinations 31 so that each of the plurality of bar combinations 31 is disposed between two adjacent columns 9 as shown in FIG. 2B, wherein the two ends 31A of each of the plurality of bar combinations 31 are respectively disposed on top of the two adjacent columns 9 of the plurality of columns 9, and the connection sections 311A of the plurality of lower main bars 311 of adjacent plurality of bar combinations 31 overlap as shown in FIG. 2C; and connecting the plurality of connection sections 311A of the plurality of lower main bars 311 of the adjacent plurality of bar combinations 31. In accordance with the above steps, the plurality of bar combinations 31 is connected in series in one direction. As shown in FIG. 2D, plural sets of bar combinations 31 are arranged in the longitudinal and transverse directions of a plant and are disposed within a predetermined area defined by the weight-bearing pillars 100 in the plant for forming beams.

As shown in FIG. 2A, each of the plurality of bar combinations 31 comprises a plurality of lower main bars 311 and a plurality of lower stirrups 312 pre-assembled and fastened together so as to provide sufficient strength during the hoisting process. Thereby, during the process of hoisting the plurality of pre-assembled bar combinations 31, the bar combinations 31 do not tend to deflect or be displaced. Moldboards 7 are not required for supporting bars during the hoisting step and thus the process is simplified. The method for forming a plurality of beams 3 utilizes pre-assembling a plurality of bar combinations 31 so as to save time for fastening bars at the construction site and ensure the fastening quality. Safety issues created by high-altitude operations of workers can be greatly eliminated as well.

Figure 3A:
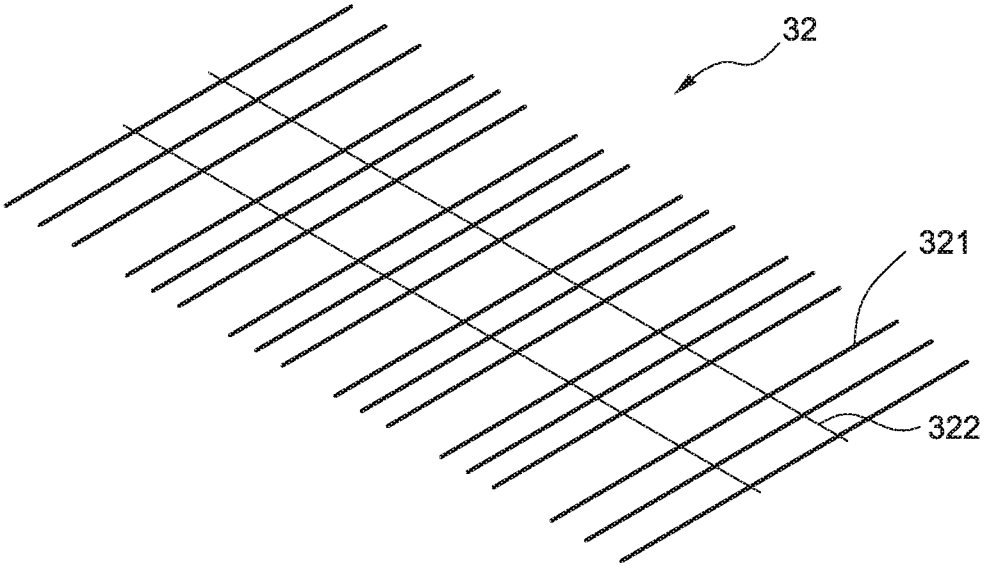
FIGS. 3A and 3B are schematic views showing the formation of lower stirrups according to the embodiment.
Figure 3B:
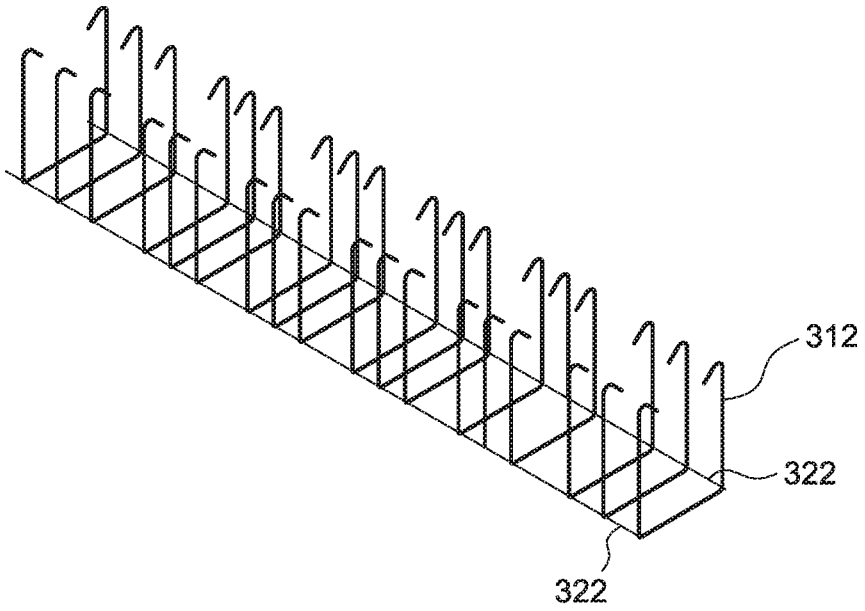

The step of providing the plurality of pre-assembled bar combinations 31 comprises a step of pre-assembling the plurality of lower main bars 311 and the plurality of lower stirrups 312, which is shown in FIGS. 2A and 3A-3B and described below. First, a plurality of transverse bars 321 interlaced with a plurality of longitudinal tendons 322 is provided as shown in FIG. 3A. Second, the plurality of transverse bars 321 are secured to the plurality of longitudinal tendons 322 through friction welding or resistance welding to form a web 32. After that, the plurality of transverse bars 321 is bent upward to form the plurality of lower stirrups 312 as shown in FIG. 3B. Preferably, the plurality of lower stirrups 312 is bent so that they are U-shaped and so that two ends of each of the plurality of U-shaped lower stirrups 312 are bent to form an inwardly bent hook, respectively. Last, the plurality of lower stirrups 312 is secured to the plurality of lower main bars 311 as shown in FIG. 2A.

As shown in FIGS. 2B and 2C, a top of each of the columns 9 contains a base 91. During the hoisting process, the two ends 31A of each of the plurality of bar combinations 31 are disposed on the plurality of bases 91 of the two adjacent columns 9 of the plurality of columns 9. Preferably, the plurality of columns 9 and the plurality of bases 91 are precast and are integrally formed. In another embodiment, the plurality of columns 9 and the plurality of bases 91 are cast at the construction site.

As shown in FIGS. 2B and 2C, the plurality of columns 9 contains a plurality of column bars 93 extending through the bases 91 of the plurality of columns 9. After hoisting the plurality of bar combinations 31 to the predetermined locations, the method further comprises a step of binding the plurality of the lower main bars 311 of the plurality of bar combinations 31 with the plurality of column bars 93 of the plurality of columns 9.

Figure 4A:
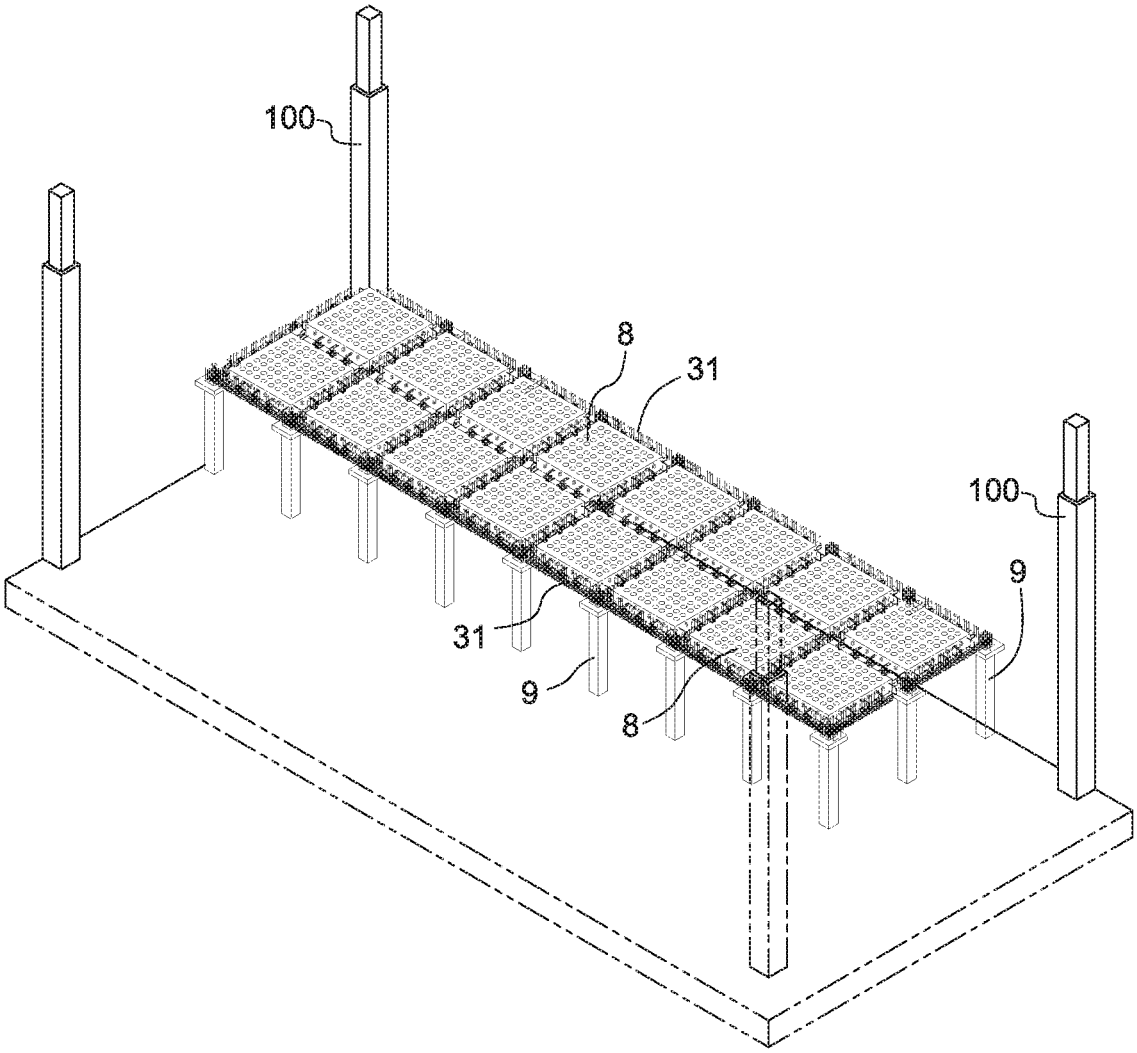
FIG. 4A is a schematic view showing a plurality of waffle slabs disposed between the pre-assembled bar combinations in a plant according to one embodiment of this disclosure.

After the above steps, the method further comprises a step of disposing a plurality of floors on at least one side of each of the plurality of bar combinations 31. Preferably, as shown in FIG. 4A, a plurality of waffle slabs 8 is disposed on at least one side of each of the plurality of bar combinations 31 within the area defined by the weight-bearing pillars 100 in a plant according to one specific embodiment. As shown in FIG. 4A, the waffle slabs 8 are disposed on only one side of the bar combinations 31 at the edge of the floor. One of the reasons of using the waffle slabs 8 as the floors of a plant is to fulfill the need of high precision required by the industry of high-tech electronics. The machines used for making the high-tech electronics as well as the high-tech electronics themselves have to be free of dust to accomplish the high-precision requirement. Waffle slabs 8 are typically used in a clean room carrying the machines for discharging dust from the clean room via the through holes 82 in the waffle slabs 8 with the positive pressure in the clean room. Then, the discharged air is filtered and returned to the clean room again.

Figure 4B:
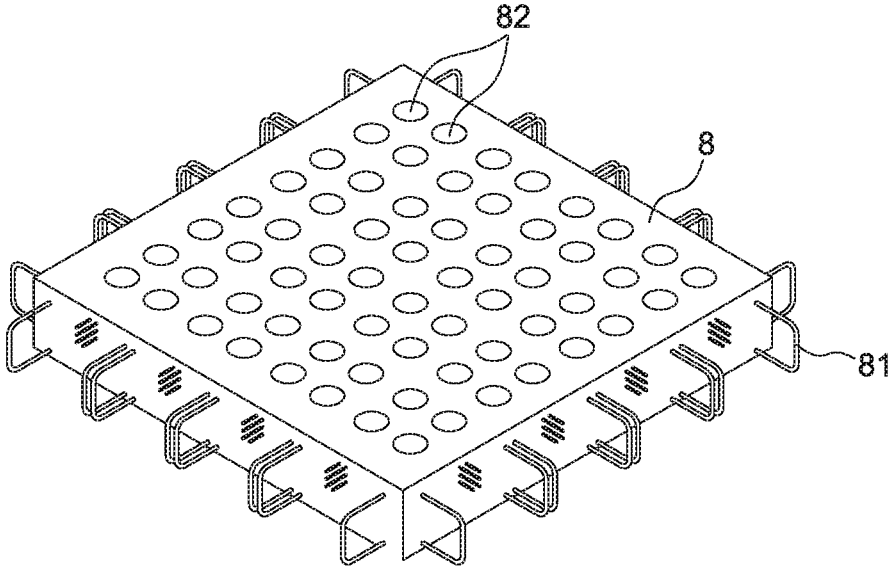
FIG. 4B is a schematic view of a single waffle slab according to one embodiment of this disclosure.

As shown in FIG. 4B, sides of a waffle slab 8 contain a plurality of connection structures 81 protruding from these sides. In one embodiment of this disclosure, the method described in the above embodiments further comprises a step of binding the plurality of bar combinations 31 with the plurality of bar connection structures 81 of the plurality of waffle slabs 8 to enhance the strength of the floor as a whole. In another embodiment of this disclosure, the step of disposing the plurality of floors (e.g., the waffle slabs 8) is executed before the step of hoisting the two ends 31A of each of the plurality of bar combinations 31 respectively on the top of the two adjacent columns 9 of the plurality of columns 9. That is, the order of the step of hoisting the plurality of bar combinations 31 and the step of disposing the waffle slabs 8 can be alternatively exchanged.

Figure 5:
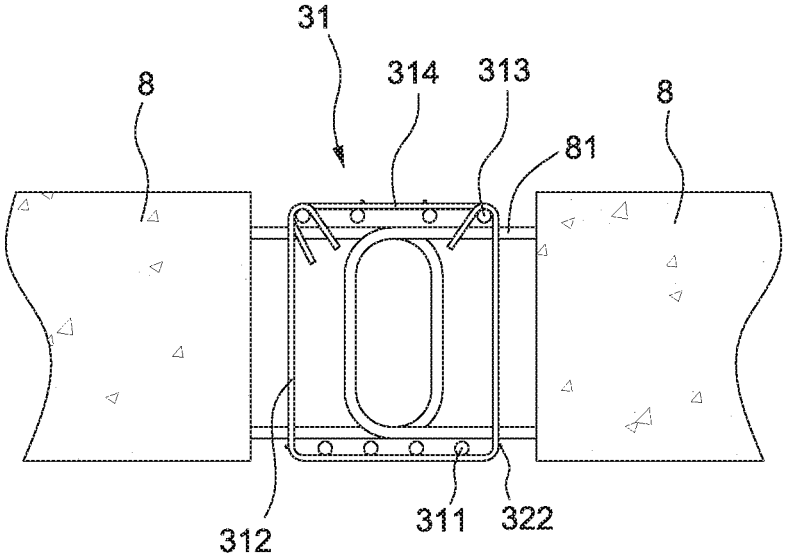
FIG. 5 is a schematic view showing that upper main bars and upper stirrups are bound to the plurality of bar combinations according to one embodiment of this disclosure.

After the step of connecting the plurality of connection sections 311A of the plurality of lower main bars 311 of the adjacent plurality of bar combinations 31, the method for forming a plurality of beams 3 of this disclosure as described above further comprises a step of binding a plurality of upper main bars 313 and a plurality of upper stirrups 314 to the plurality of bar combinations 31 as shown in FIG. 5. In another embodiment of this disclosure, the step of binding the plurality of upper main bars 313 and the plurality of upper stirrups 314 to the plurality of bar combinations 31 is executed before or after the step of disposing the plurality of the floors (e.g., the waffle slabs 8) on at least one side of each of the plurality of bar combinations 31.

Figure 6A:
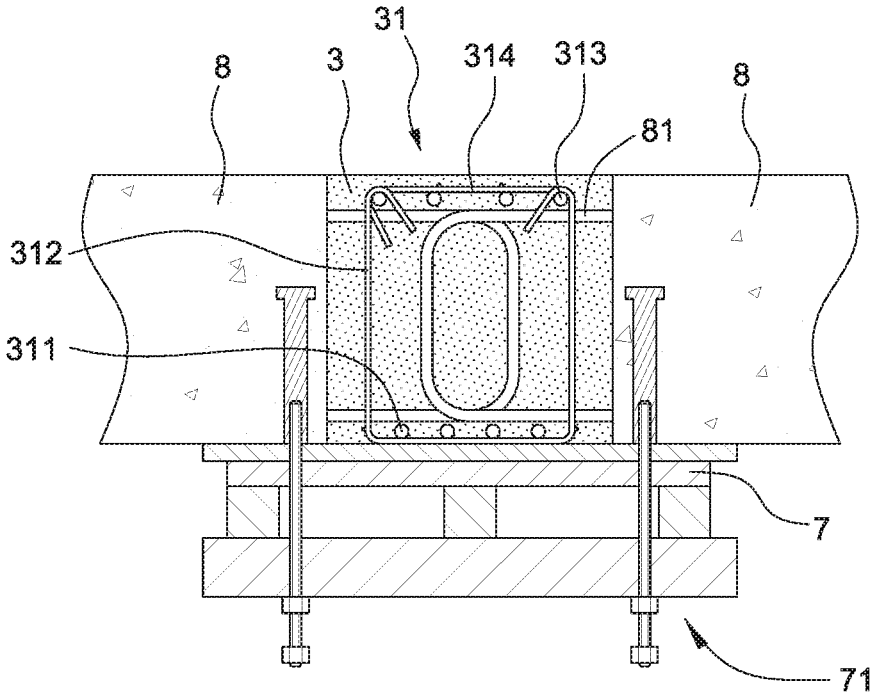
FIGS. 6A and 6B are schematic views showing a plurality of moldboards disposed under the plurality of bar combinations and between the plurality of waffle slabs, wherein concrete is poured therein to form a beam according to one embodiment of this disclosure.
Figure 6B:
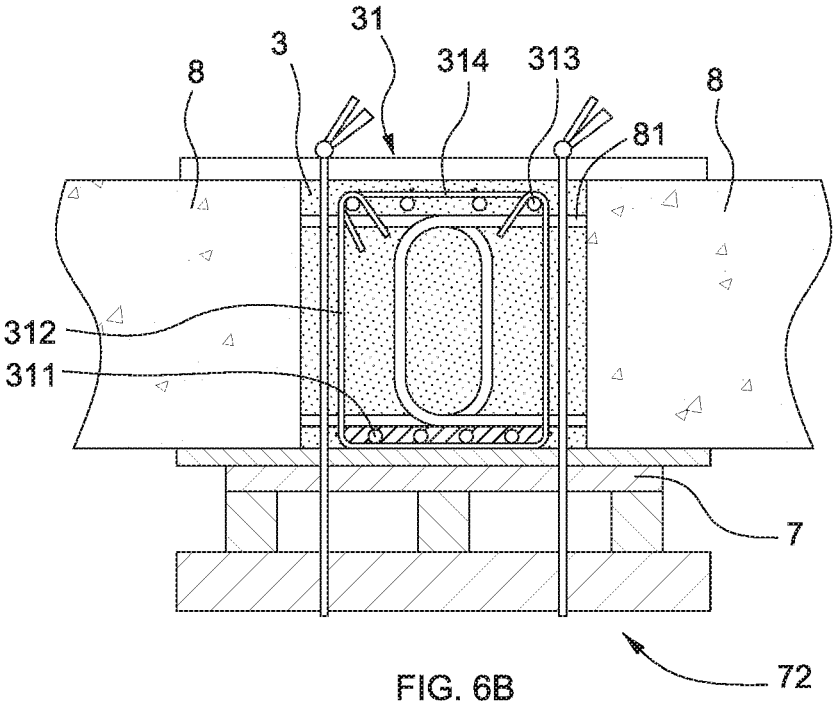

After the step of disposing the plurality of the waffle slabs 8 on at least one side of each of the plurality of bar combinations 31, the method for forming a plurality of beams 3 of this disclosure as described above further comprises a step of disposing a plurality of moldboards 7 under the plurality of bar combinations 31 and between the plurality of waffle slabs 8 as shown in FIGS. 6A and 6B. FIGS. 6A and 6B illustrate two different bottom sealing devices 71, 72, respectively. By means of the bottom sealing devices 71, 72, the plurality of moldboards 7 can be disposed under the plurality of bar combinations 31 and between the plurality of waffle slabs 8 for sealing the bottoms.

After the step of disposing the plurality of moldboards 7 under the plurality of bar combinations 31 and between the plurality of waffle slabs 8, the method for forming the beams 3 of this disclosure further comprises a step of pouring concrete into a space formed by side surfaces of the plurality of waffle slabs 8 at both sides of each of the plurality of bar combinations 31 and the plurality of moldboards 7 to form the plurality of beams.

Figure 7:
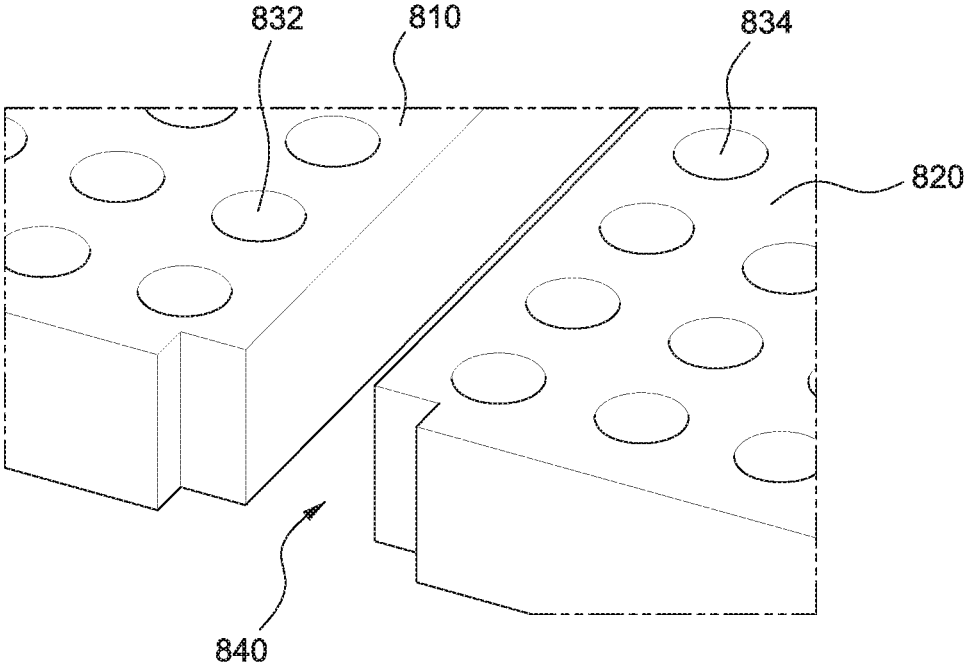
FIG. 7 is a schematic view showing the relative positions between a first waffle slab and a second waffle slab according to one embodiment of this disclosure.

FIG. 7 is a schematic view showing the relative positions between a first waffle slab 810 and a second waffle slab 820. A gap 840 is formed between the waffle slabs for receiving a bar combination made in accordance with this disclosure. The bottoms 818, 828 of the first waffle slab 810 and the second waffle slab 820 are aligned generally in a same plane (see FIG. 8B) and respectively have a first set of through holes 832 and a second set of through holes 834. The first waffle slab 810 is spaced apart from the second waffle slab 820 with the gap 840, which is for placement of a bar combination 31 and then pouring concrete to a beam. The first waffle slab 810 and the second waffle slab 820 are formed with recesses at corners thereof. The recesses correspond to edges of a column 9 (not shown). The through holes 832, 834 are fully distributed in the first waffle slab 810 and the second waffle slab 820 illustrated in FIG. 7, and thus the waffle slabs 810, 820 have the appearance of a piece of Swiss cheese. In an alternative embodiment, the through holes 832, 834 are selectively disposed in the waffle slabs 810, 820 according to the needs. Some of these through holes 832, 834 can be used to fix a bottom sealing structure to cover the gap 840.

Figure 8A:
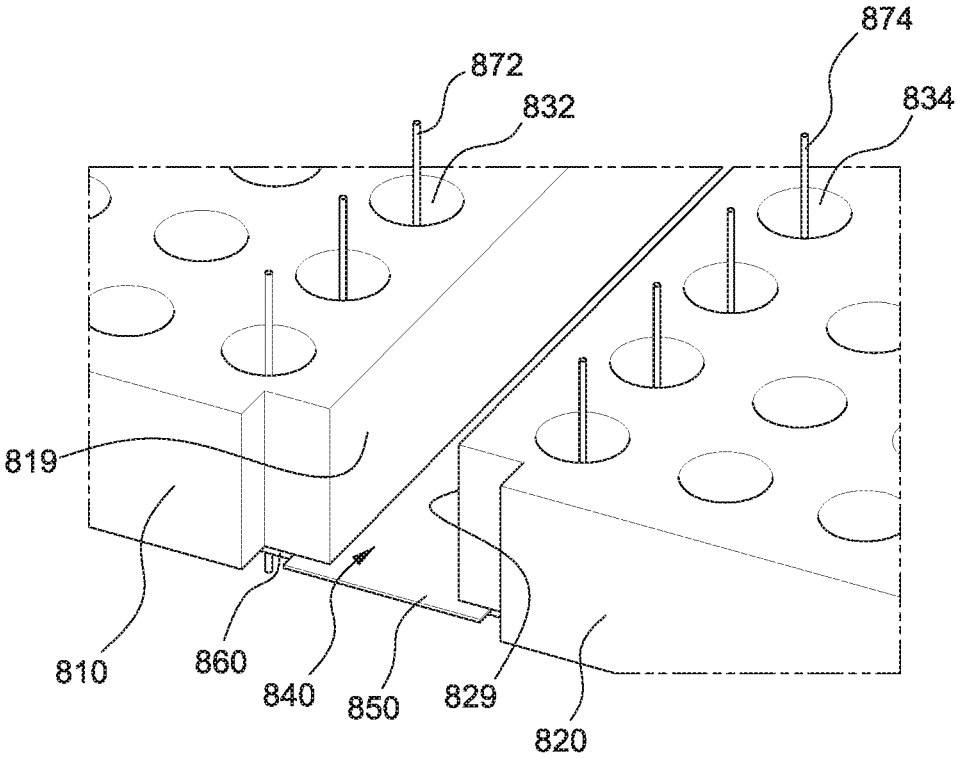
FIG. 8A is a top perspective view showing the gap between two adjacent waffle slabs, wherein the gap is sealed according to one embodiment of this disclosure.
Figure 8B:
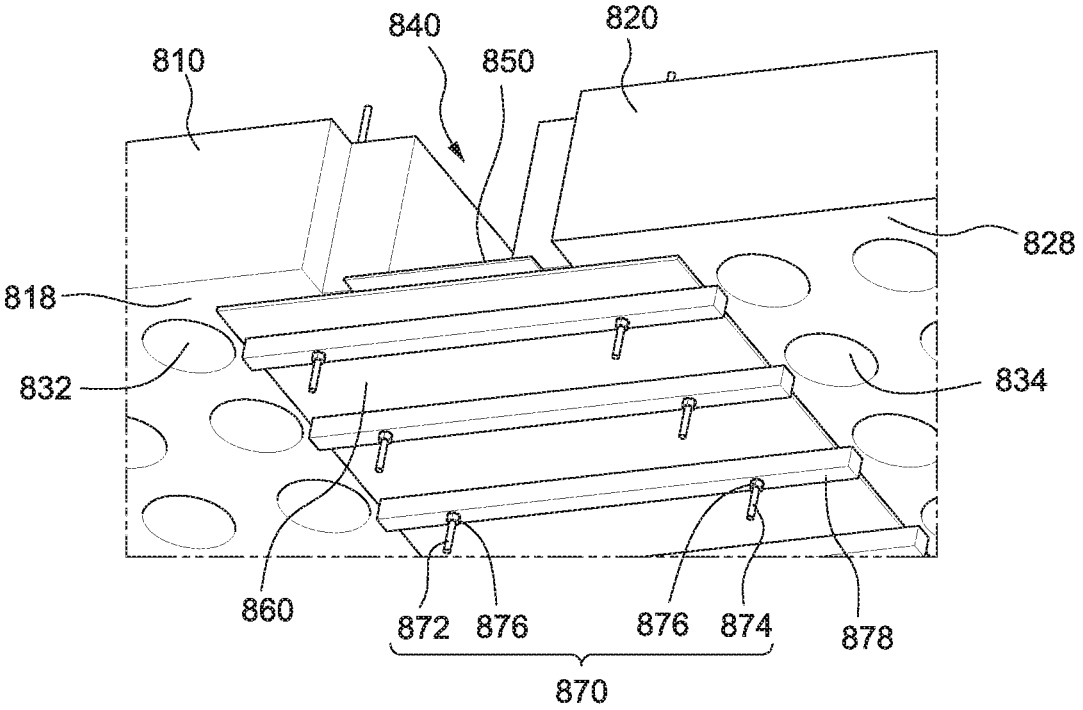
FIG. 8B is a bottom perspective view showing that the gap is sealed according to one embodiment of this disclosure.

FIG. 8A and FIG. 8B are respectively a perspective top view and a perspective bottom view showing the bottom sealing structure that covers the gap 840 between the waffle slabs 810, 820. The first waffle slab 810 and the second waffle slab 820 each have an inner edge 819, 829 adjacent to the gap 840. The top of the gap 840 is open for concrete to be poured therein to form the beam 3. The bottom of the gap 840 is sealed with a soft pad 850 from a bottom side. The soft pad 850 has a sufficient width for covering the inner edges 819, 829 of the first waffle slab 810 and the second waffle slab 820 so that the gap 840 is fully covered and sealed by the soft pad 850. The material of the soft pad 850 may be rubber, soft plastic, silicone etc. The soft pad 850 with a proper clamping device or fixing device provides a tight sealing and is able to prevent concrete in a liquid or quasi-liquid state from penetrating through the gap 840. Even if the bottoms 818, 828 of the first waffle slab 810 and the second waffle slab 820 are uneven or unaligned, the soft pad 850 with its flexible nature can remedy those issues and provide a great sealing function.

As shown in FIG. 8B, a moldboard 860 is abutted against the soft pad 850 from the bottom side and spans across the inner edge 819 of the first waffle slab 810 and the inner edge 829 of the second waffle slab 820. The moldboard 860 is used for supporting and clamping the soft pad 850 to the waffle slabs 810, 820. The material of the moldboard 860 may be common wood boards or others that can achieve the same function.

A fastening device 870 is provided to fasten a first side and a second side opposite the first side of the moldboard 860 respectively to the first waffle slab 810 and the second waffle slab 820 so that two sides of the soft pad 850 are sandwiched respectively between the moldboard 860 and the first waffle slab 810 and the second waffle slab 820 for tightly sealing the bottom of the gap 840 with the soft pad 850. An end of the fastening device 870 is fixed on the top surfaces of the first waffle slab 810 and the second waffle slab 820 via at least a part of the first set of through holes 832 and the second set of through holes 834. The fastening device 870 does not contact the soft pad 850. Specifically, the fastening device 870 does not penetrate the soft pad 850. Therefore, the soft pad 850 is not damaged. The fastening device 870 preferably comprises a first set of bolt fastening devices consisting of screws 872 and nuts 876, and a second set of bolt fastening devices consisting of screws 874 and nuts 876.

The first set of bolt fastening devices passes through the first side of the moldboard 860 and at least some through holes 832 of the first set of through holes 832 and is secured at the tops of the first waffle slab 810 for fastening the first side of the moldboard 860 to the first waffle slab 810. Similarly, the second set of bolt fastening devices passes through the second side of the moldboard 860 and at least some through holes 834 of the second set of through holes 834 and is secured at the tops of the second waffle slab 820 for fastening the second side of the moldboard 860 to the second waffle slab 820.

If the strength of the moldboard 860 (e.g., a moldboard made of wood) is insufficient, the weight of the concrete poured into the gap 840 may cause the moldboard 860 to bend or deflect and damage the sealing effect of the soft pad 850. To enhance the strength and durability of the moldboard 860, and make the force applied to the moldboard 860 evenly, a first set of ribs 878 is placed against the moldboard 860 and extends from a first side of the moldboard 860 to a second side of the moldboard 860. The first set of bolt fastening devices and the second set of bolt fastening devices pass through two ends of each of the first set of ribs 878 so that the first end of each of the ribs 878 and the first side of the moldboard 860 are fastened to the first waffle slab 810, and the second end of each of the ribs 878 and the second side of the moldboard 860 are fastened to the second waffle slab 820. Preferably, the ribs 878 are made of angle bars or rectangle tubes.

Figure 9:
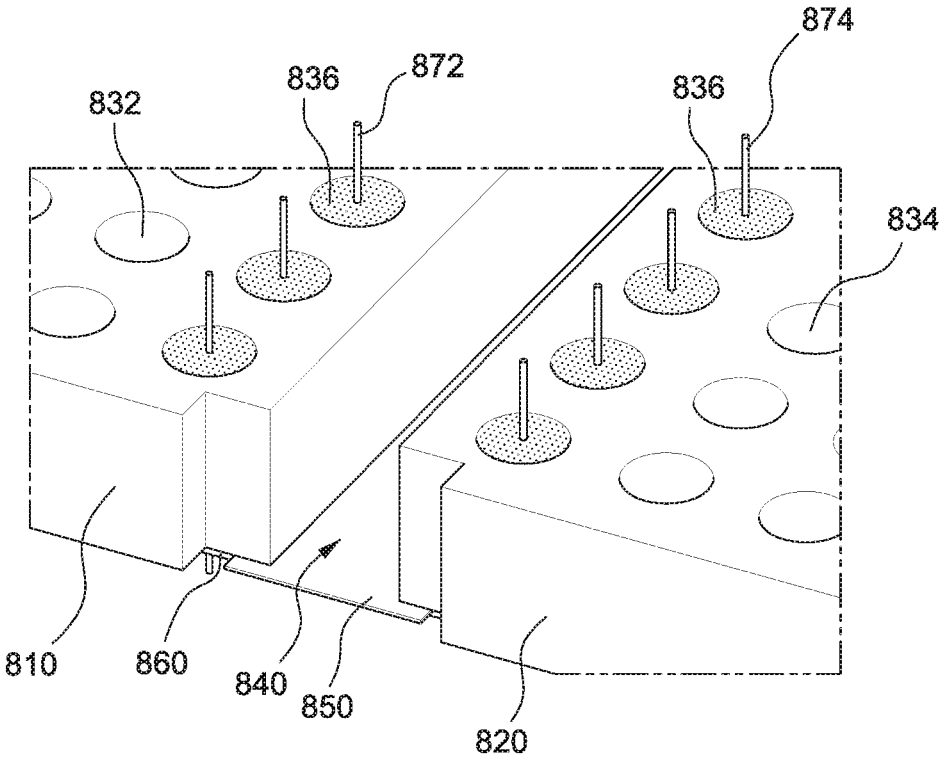
FIG. 9 is a schematic view illustrating covers being provided on through holes shown in FIGS. 8A and 2B.
Figure 10A:
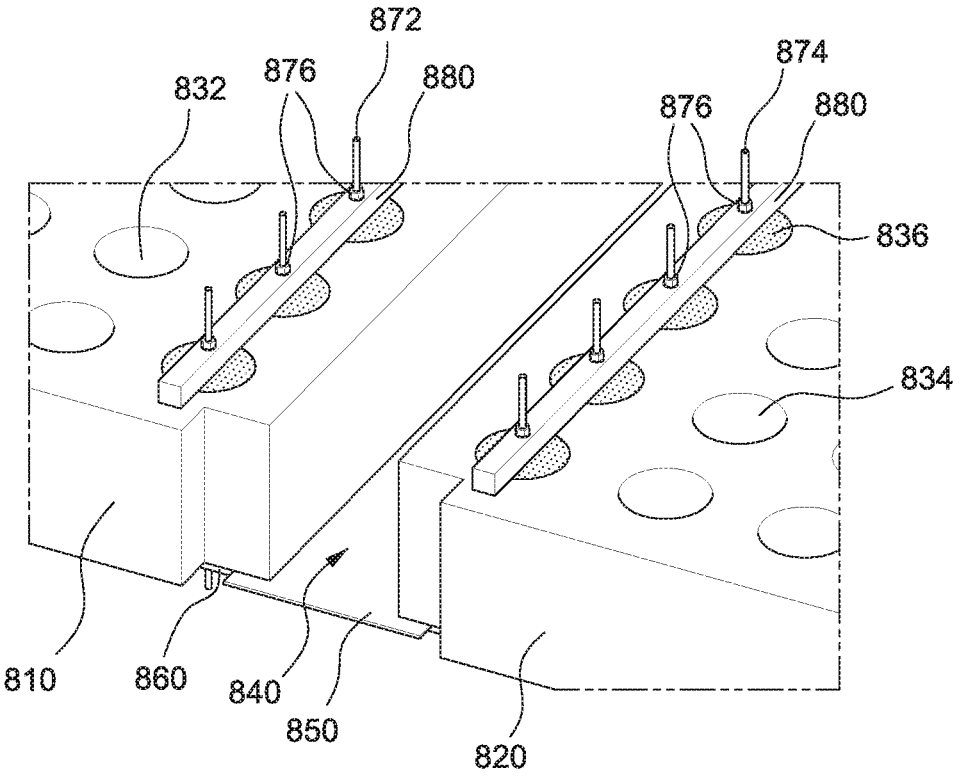
FIGS. 10A-10C and FIG. 11 are schematic views showing second ribs being placed on the top surfaces of the waffle slabs according to one embodiment of this disclosure.
Figure 10B:
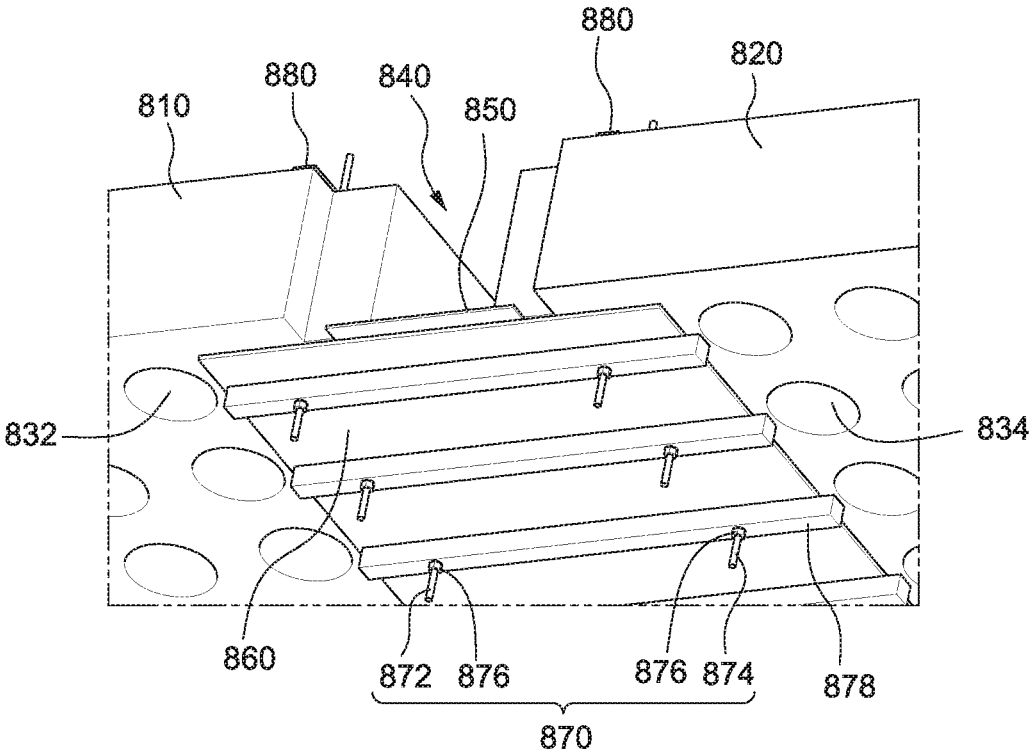
Figure 10C:
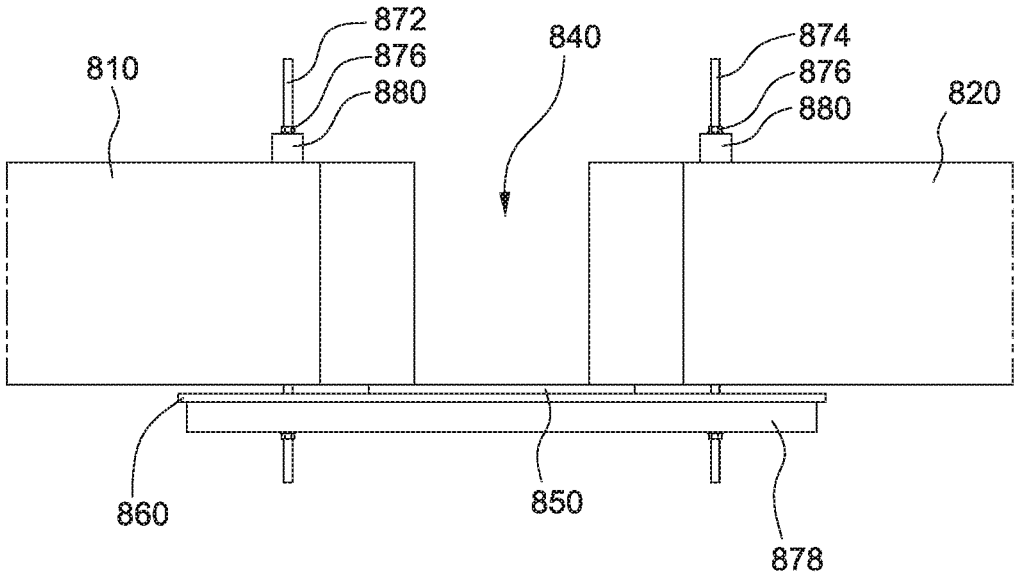
Figure 11:
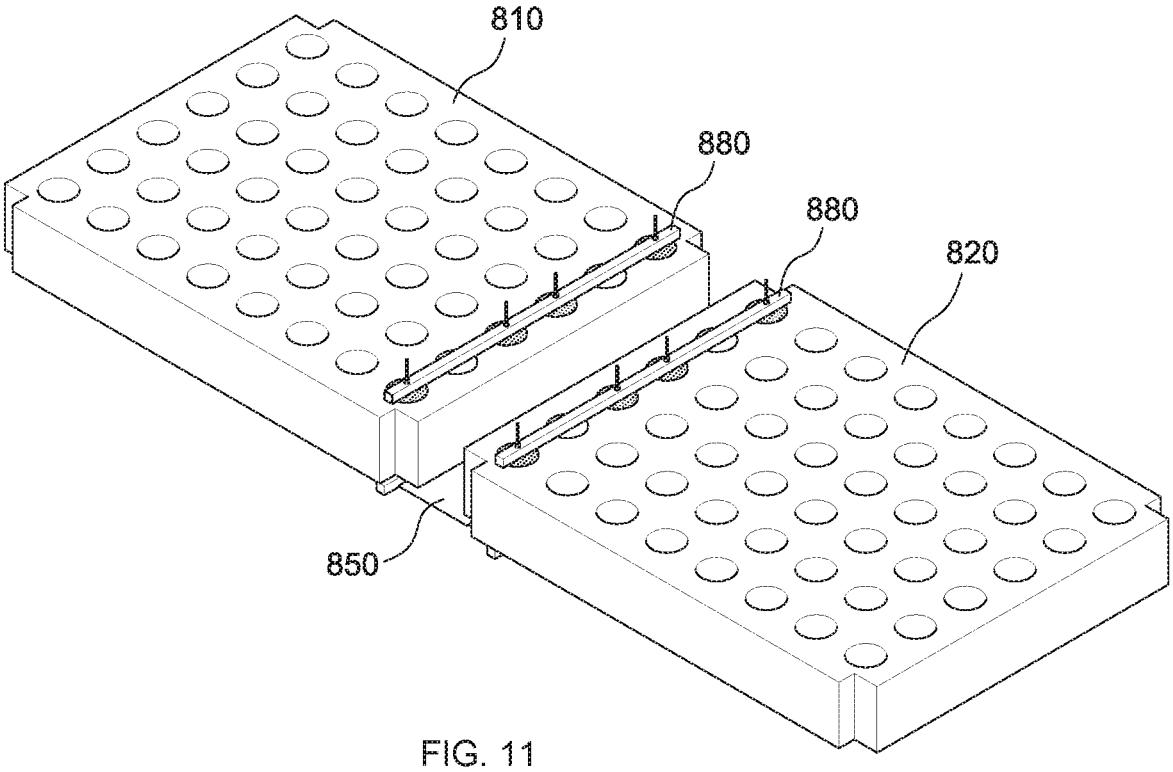

As shown in FIG. 9, at least some of the through holes 832, 834 are covered by covers 836 to prevent falling of nearby workers into the through holes 832, 834.

Furthermore, as shown in FIG. 10A, FIG. 10B, FIG. 10C and FIG. 11, a second set of ribs 880 for securing the moldboard 860 is placed against and is secured to the top surfaces of the first waffle slab 810 and the second waffle slab 820 through the fastening device 870. Please refer to FIGS. 10A-10C wherein the first set of bolt fastening devices and the second set of bolt fastening devices respectively extend through one rib 880 of the second set of ribs 880. That is, the second set of ribs 880 comprises a first rib 880 fastened with the first waffle slab 810 and a second rib 880 fastened with the second waffle slab 820.

Figure 12:
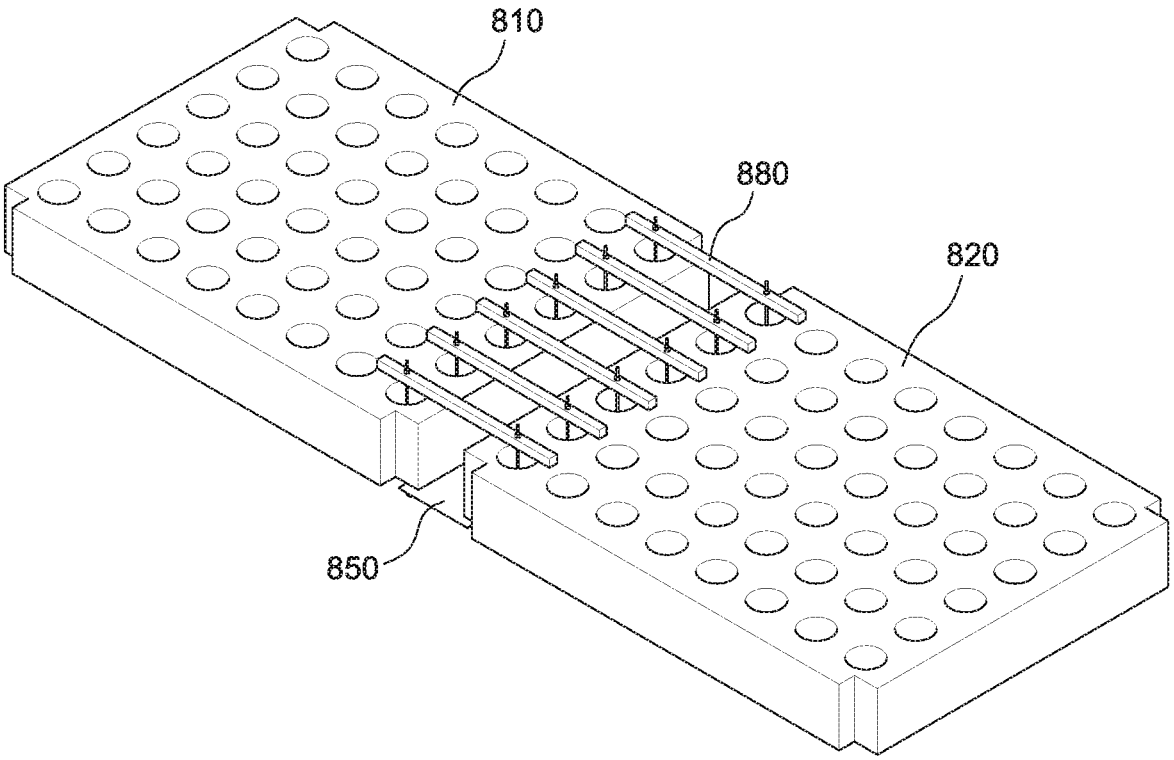
FIG. 12 is a schematic view showing second ribs in another configuration being placed on the top surfaces of the waffle slabs according to another embodiment of this disclosure.

FIG. 12 shows another embodiment of the second set of ribs 880. The two ends of the second set of ribs 880 are respectively fastened to the first waffle slab 810 and the second waffle slab 820. That is, the first set of bolt fastening devices and the second set of bolt fastening devices respectively pass through the first end and the second end of each of the second set of ribs 880 so that the first end of each of the second set of ribs 880 is fastened on top of the first waffle slab 810, and the second end of each of the second set of ribs 880 moldboard are fastened on top of the second waffle slab 820.

This disclosure is not limited by the specific steps disclosed herein. A person skilled in the art can understand these steps disclosed herein may be changed or exchanged without deviating from the spirit of the disclosure. It should be also understood that the terminology and the directions or relative positions indicated herein are used for easy understanding only and do not limit the scope.

What is claimed is:

1. A method for forming a construction structure, comprising the following steps:

providing a plurality of columns;

providing a plurality of pre-assembled bar combinations, wherein each of the plurality of bar combinations comprises a plurality of lower main bars and a plurality of lower stirrups, at least one end of the plurality of the lower main bars has connection sections extending beyond the plurality of lower stirrups;

hoisting each of the plurality of bar combinations so that each of the plurality of bar combinations is disposed between two adjacent columns, wherein the two ends of each of the plurality of bar combinations are respectively disposed on top of the two adjacent columns of the plurality of columns, and the connection sections of the plurality of lower main bars of adjacent plurality of bar combinations overlap;

connecting the plurality of connection sections of the plurality of lower main bars of the adjacent plurality of bar combinations;

providing a first waffle slab and a second waffle slab at both sides of each of the plurality of bar combinations, the bottoms of the first waffle slab and the second waffle slab being aligned generally in a same plane, the first waffle slab and the second waffle slab having a first set of through holes and a second set of through holes, respectively, wherein the first waffle slab is spaced apart from the second waffle slab with a gap, and the first waffle slab and the second waffle slab each have an inner edge adjacent the gap;

sealing a bottom of the gap with a soft pad from a bottom side so that the inner edge of the first waffle slab and the inner edge of the second waffle slab are covered by the soft pad;

abutting a moldboard against the soft pad from the bottom side; and providing a fastening device to fasten a first side and a second side opposite the first side of the moldboard to the first waffle slab and the second waffle slab, respectively, so that two sides of the soft pad are sandwiched between the moldboard and the first waffle slab and the second waffle slab, respectively, and an end of the fastening device being fixed on top surfaces of the first waffle slab and the second waffle slab via at least a part of the first set of through holes and the second set of through holes.

2. The method as in claim 1, further comprising a step of binding a plurality of upper main bars and a plurality of upper stirrups to the plurality of bar combinations.

3. The method as in claim 2, further comprising a step of disposing a plurality of moldboards under the plurality of bar combinations and between the first waffle slab and the second waffle slab, and a step of pouring concrete into a space formed by side surfaces of the first waffle slab and the second waffle slab at both sides of each of the plurality of bar combinations and the plurality of moldboards to form the plurality of beams.

4. The method as in claim 2, wherein a top of each of the columns contains a base, wherein the step of hoisting each of the plurality of bar combinations comprises disposing the two ends of each of the plurality of bar combinations on the plurality of bases of the two adjacent columns of the plurality of columns, and wherein the plurality of columns and the plurality of bases are precast and are integrally formed.

5. The method as in claim 4, wherein the plurality of columns contains a plurality of column bars extending through the bases of the plurality of columns, and the method further comprises a step of binding the plurality of the lower main bars of the plurality of bar combinations with the plurality of column bars of the plurality of columns.

6. The method as in claim 1, wherein two sides of the first waffle slab and the second waffle slab contain a plurality of connection structures protruding from the two sides, and the method further comprises: a step of binding the plurality of bar combinations with the plurality of bar connection structures of the first waffle slab and the second waffle slab.

7. The method as in claim 3, wherein the step of disposing the plurality of moldboards under the plurality of bar combinations and between the first waffle slab and the second waffle slab comprises the following steps:

placing a set of ribs against the top surfaces of the first waffle slab and the second waffle slab, and securing the set of ribs with the first waffle slab and the second waffle slab via the fastening device, wherein the set of ribs comprises a first rib fastened with the first waffle slab and a second rib fastened with the second waffle slab.

8. The method as in claim 3, wherein the step of providing the plurality of pre-assembled bar combinations comprises a step of pre-assembling the plurality of lower main bars and the plurality of lower stirrups, which comprises the following steps:

providing a web formed by a plurality of transverse bars interlaced with a plurality of longitudinal tendons;

bending upward the plurality of transverse bars to form the plurality of lower stirrups, wherein the plurality of lower stirrups are bent so that they are U-shaped, and two ends of each of the plurality of U-shaped lower stirrups are bent to form an inwardly bent hook; and securing the plurality of lower stirrups to the plurality of lower main bars.

* * * * *